United States Patent [19]

Disher et al.

[11] Patent Number: 4,681,173

[45] Date of Patent: Jul. 21, 1987

[54] METHOD AND APPARATUS FOR DRILLING A GROUP OF SUBSEA WELLS

[75] Inventors: Brennan C. Disher; Steven H. Tate, both of Morgan City, La.

[73] Assignee: Texaco Inc., White Plains, N.Y.

[21] Appl. No.: 756,544

[22] Filed: Jul. 19, 1985

[51] Int. Cl.[4] ..... E21B 7/128

[52] U.S. Cl. ..... 175/7; 166/349; 166/358; 166/366; 173/45; 175/220

[58] Field of Search ..... 175/5, 7, 8, 10, 220, 175/108; 166/358, 342, 349, 52, 85, 366; 405/195; 173/45

[56] References Cited

U.S. PATENT DOCUMENTS

| | | | |
|---|---|---|---|
| 276,791 | 5/1883 | Engle, Jr. | 403/108 |
| 3,316,963 | 5/1967 | Boldrick et al. | 166/85 |
| 3,550,969 | 12/1970 | Robinson | 403/188 |
| 4,110,993 | 9/1978 | Heerema | 173/45 |
| 4,216,835 | 8/1980 | Nelson | 175/10 |
| 4,387,771 | 6/1983 | Jones | 166/341 |

FOREIGN PATENT DOCUMENTS

| | | | |
|---|---|---|---|
| 101895 | 9/1937 | Australia | 173/45 |
| 418267 | 2/1967 | Switzerland | 173/45 |
| 311961 | 5/1929 | United Kingdom | 175/220 |
| 2138472 | 10/1984 | United Kingdom | 175/220 |
| 233580 | 4/1969 | U.S.S.R. | 173/45 |
| 1062367 | 12/1983 | U.S.S.R. | 175/7 |

*Primary Examiner*—James A. Leppink
*Assistant Examiner*—Hoang C. Dang
*Attorney, Agent, or Firm*—Robert A. Kulason; James J. O'Loughlin; Robert B. Burns

[57] ABSTRACT

Conductor guides for use in drilling wells in an offshore body of water wherein the wells are positioned in close proximity one to the other. A first clamping member is removably attached to a well which includes a conductor or well head protruding therefrom. A conductor guide is spaced a predetermined distance from the clamping by means of a connecting beam that extends therebetween. The connecting beam is adjusted to properly position the conductor guide on the ocean floor at a fixed distance and directional relationship with the first conductor.

3 Claims, 5 Drawing Figures

FIG. 2
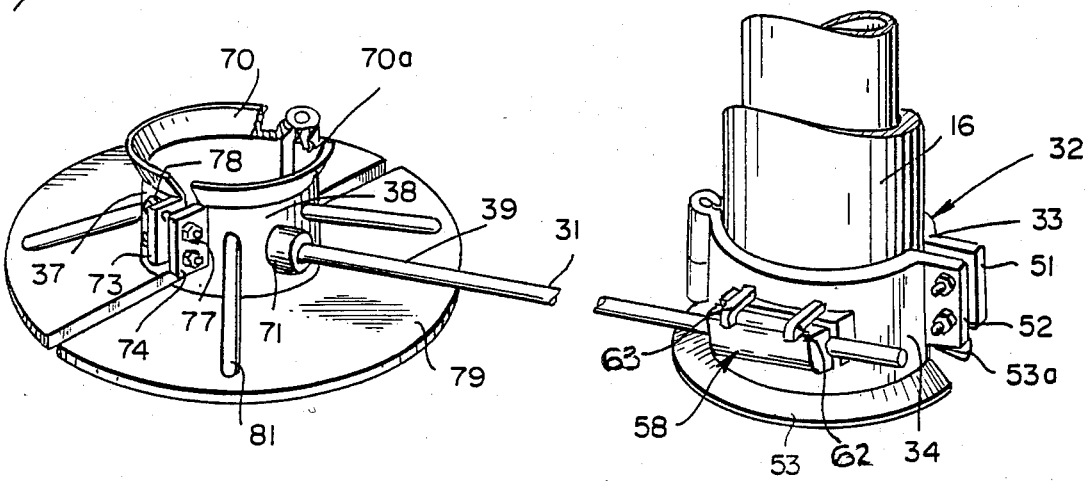
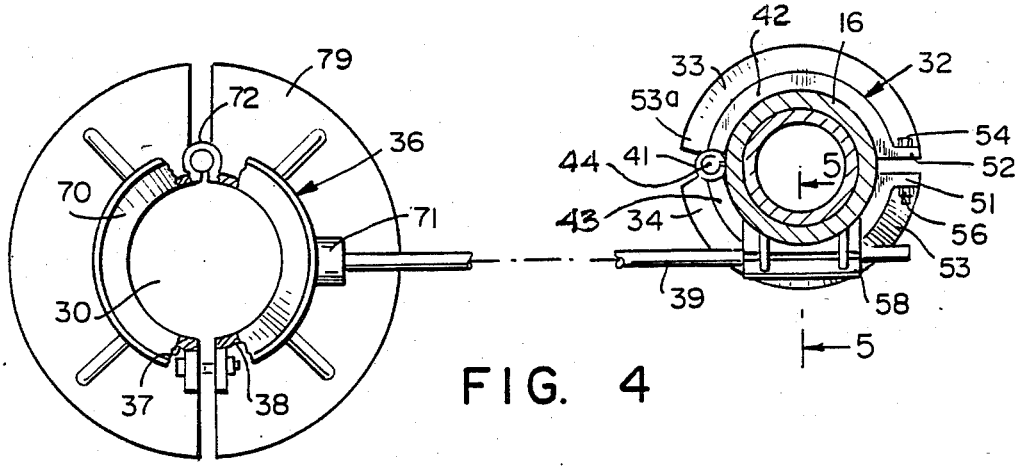
FIG. 4
FIG. 3
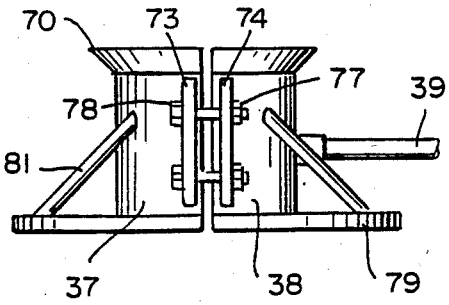
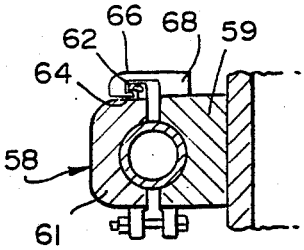
FIG. 5

METHOD AND APPARATUS FOR DRILLING A GROUP OF SUBSEA WELLS

BACKGROUND OF THE INVENTION

In the exploration for and the drilling of hydrocarbon containing substrates at offshore sites, normally test borings are made, or exploratory wells are drilled directly into a subterranean formation. Scientific testing methods will thereafter be used to determine its hydrocarbon content. Depending on the amount of hydrocarbon which is determined to be held in the formation, one or more wells can be drilled for production purposes.

If the formation is determined to be relatively large or productive, it might be economically desirable to build and set a structure or platform which is capable of drilling a desired number of wells at the offshore site whereby to realize maximum production.

Such platforms can be massive, depending on water depth. The overall cost is relatively expensive, dependent on the water depth. After the field or formation has become depleted, however, disposing of a piled structure can be expensive depending on environmental requirements, and once again on the depth of the water in which the structure is set.

In some instances the productivity of a field does not justify furnishing a structure capable of drilling the necessary subsea wells. An economic alternative is to merely drill individual wells which are positioned a set distance from a previously erected structure. Thereafter, produced fluid is moved by pipeline to the platform or structure. It can then be processed, treated and shipped or pipelined to a shore base.

In the instance of satellite subsea wells of this type the wells can be drilled by any one of a variety of drilling vessels. Preferably a vessel of the semisubmersible type can be positioned above the wall site and the drilling operation carried out. In such an arrangement it is necessary to extend a riser column from the well to the water's surface. A rotating drill string can then be lowered into the formation.

It may in some instances be determined economically worthwhile to produce a field and still utilize a remote existing marine structure or even a pipeline to carry produced fluids to shore. Thus, a number of wells can still be drilled into the formation to achieve maximum production.

Any offshore well drilling operation is substantially facilitated through use of a drilling template which is lowered to the ocean floor. The function of a multi-slot template is to provide a series of rigidly positioned, ring-like conductor guides. The latter are spaced one from the other a predetermined distance in a predetermined pattern or arrangement.

Functionally, a drill string is lowered through a conductor, which has been preset with the aid of the template. Thereafter, a rotating drill string can be diverted into a desired direction toward a particular part of the field or formation.

In either instance, as each well is completed through a template slot, the well is provided with the necessary casing, well head, and eventually a Christmas tree.

At this point in an operation, once the well is either producing or has been plugged for future use, an adjacent well can be drilled through another ring-like guide in the template, following the same procedure.

Over a period of time, if a field proves economically productive, the template is utilized until each slot or drilling guide opening accommodates a well. Beyond this point, the template is of no further use except to position Christmas trees, manifolds, and other equipment which might be utilized to gather produced fluids.

Toward alleviating the expense of providing a fixed drilling template which is abandoned after being used, and to facilitate the driling of a group of relatively closely spaced wells into the ocean floor, there is presently provided a provisional template or conductor guide which is sufficiently flexible to be reused and readjusted. The guide can also be used through being repositioned from a fixed well, to provide a pattern of wells over which a jacket can be subsequently lowered.

In brief, the subsea conductor guide apparatus embodies means for poisitioning a conductor or drill pipe which is lowered from a vessel at the surface of the water, to the ocean floor. When so positioned, the upper end of the drill pipe engages a drilling vessel such as a semisubmersible unit. The well can then be drilled by registering a conductor into the drill pipe and lowering a rotating drill string through the guide conductor toward the productive formation.

Upon completion of the first well of a group or pattern, the instant provisional conductor guide apparatus is removably engaged onto the drill pipe or casing of the completed well. This is achieved in a manner that the guide apparatus can be initially rotated about the completed drill pipe. An ancillary guide collar which depends from the unit is then vertically aligned with the next well location.

As each well in the preset pattern is progressively drilled, the provisional conductor guide apparatus is unclamped from its original position and either rotated about the original well or transferred onto the drill pipe of a second well.

It is therefore an object of the invention to provide means for drilling a group of wells to reach an offshore subterranean formation without the use of a permanently submerged template.

A further object is to provide a provisional drilling template of the type contemplated which depends from an initially drilled well whereby to determine the spacing between the two.

A still further object is to provide a well conductor guide which is provisionally connected to a well at the ocean floor whereby to foster the completion of other wells in a desired, relatively closely arranged pattern.

DESCRIPTION OF THE DRAWINGS

FIG. 2 is an enlarged view of the guide apparatus.

FIG. 3 is an elevation view of a part of FIG. 4.

FIG. 4 is a top view of the apparatus shown in FIG. 2.

FIG. 5 is a cross-sectional view taken along line 5—5 in FIG. 4.

Figure 1:
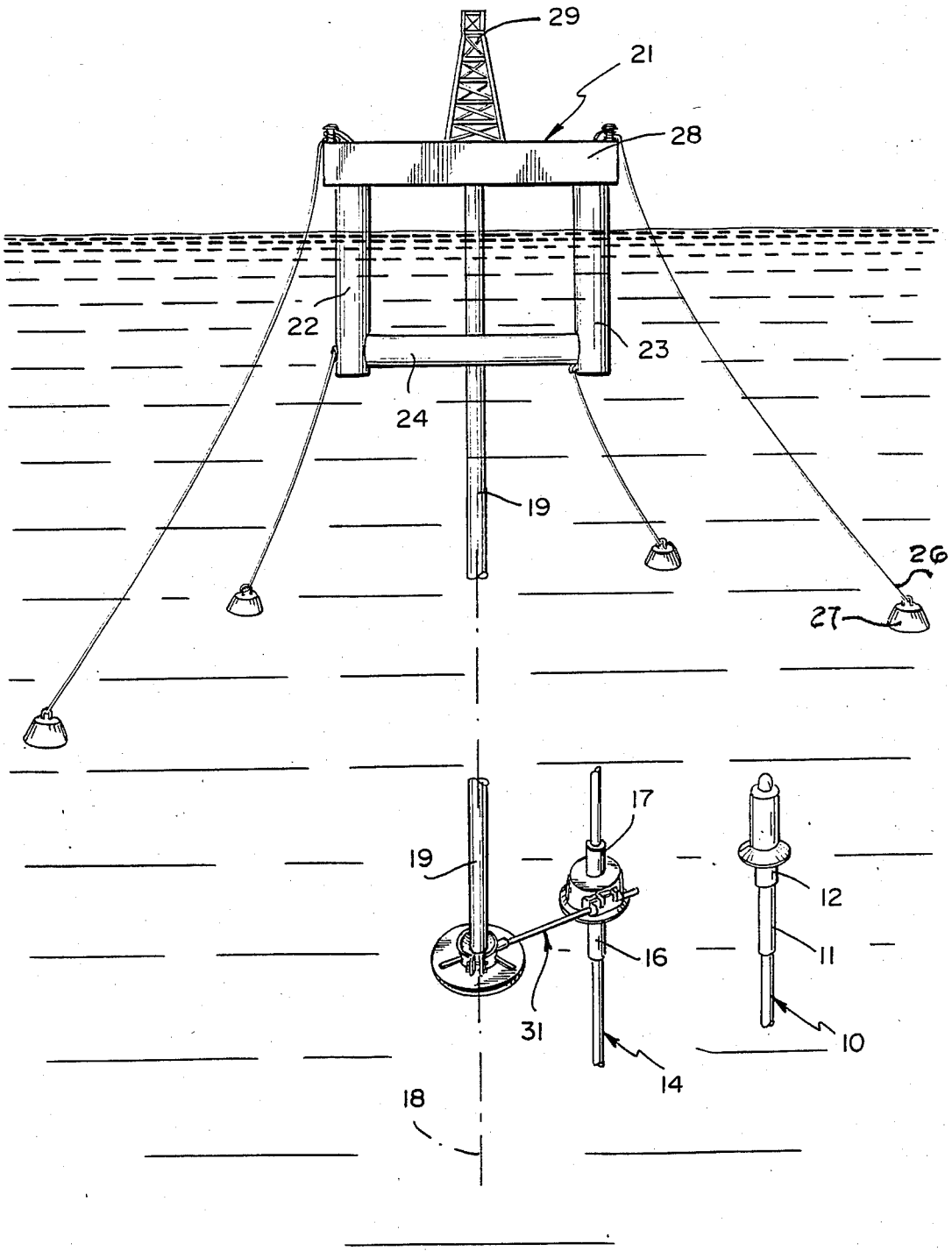
FIG. 1 illustrates an environmental depiction of the instant apparatus at the floor of a body of water.

In a proposed well pattern for a subsea drilling site, the respective wells are preferably disposed in a grid-like arrangement. There need be no particular advantage realized in the form of pattern utilized except that by placing the wells close together they can be readily drilled into a common formation. However, the well pattern can also be utilized for drilling the wells in anticipation of a jacket being placed thereover. Upon completion the respective wells can each be connected into a common manifold so that produced hydrocarbon fluids can be directed to a terminal point.

As shown, at least one well 10 of the pattern is completed with a casing 11, a well head 12, and a Christmas tree 13. The latter, in the normal manner, functions in one respect to regulate the flow of hydrocarbon fluid which is produced from the well. It also functions to regulate treatment of the well as by the injection of chemicals, water or gas as needed to enhance the production process.

A second well 14 in the formation is shown completed to the extent that a drill pipe 16 has been placed. Eventually a well head will be fixed to the top of the conductor. In the present arrangement, the conductor drill pipe 16 upper end protrudes at least several feet above the sea floor. Said drill pipe is normally formed of steel tubing approximately 26 to 30 inches in diameter.

Drill conductor 17 which is suspended within drill pipe 16 acts as a guide for permitting a drill string to be lowered from a derrick 29 at the water's surface. A third well (F) in the pattern is in the stage of being prepared for drilling. It is to be spaced from drill pipe 16 a predetermined distance, and in a predetermined direction from the latter.

Said third, or prepositioned well at (F), includes elongated drill pipe 19 which extends through the water from the sea floor, to the drilling vessel 21. The drill pipe normally penetrates the floor for a sufficient distance to provide the well's upper casing.

As a rule, the relatively heavy, upright drill pipe 19 will sink into the ocean floor depending on the latter's consistency. However, the conductor can also be set by jetting, driving, or other means to a desired depth.

The respective wells are here shown in FIG. 1 as relatively equally spaced to form a desired pattern on the sea floor. It is understood however that in some instances a particular pattern is not necessary. The pattern can, for example, be altered should such be determined to be necessary.

In the present arrangement, while the respective wells are in an orderly pattern, the use of the provisional conductor guide apparatus as will be hereinafter described more fully, will permit the adjacent well pattern to achieve a desired spacing into any pattern desired.

As shown in FIG. 1, drilling vessel 21 adapted to drill satellite wells of the type contemplated, can be comprised of a semisubmersible or similar unit which is capable of being floatably maintained over a drill site. Normally vessels of this class include a plurality of substantially vertical legs 22 and 23 which function to vary the vessel's buoyancy. Said legs 22 and 23 therefore contain controllable buoyancy tanks which permit the vessel to be raised or lowered in the water, or to permit its floating angle to be regulated.

The respective buoyant legs 22 and 23 are connected by a series of intermediate braces 24 which extend therebetween. These members can likewise be provided with buoyancy tanks and control equipment to regulate the vessel's buoyancy.

To position vessel 21 over a site of wells to be drilled, the vessel is furnished with mooring lines 26 which extend to and are fixed to prepositioned anchors 27 at the sea floor. Anchors 27 are so arranged so that the location of vessel 21 can be varied by adjusting tension on selective lines or cables.

The working portion of vessel 21 comprises a deck 28 or multiple decks adapted for holding the necessary equipment and facilities for effecting a successful drilling operation. Said facilities include the usual drilling derrick 29 which is positioned above a rotary table to permit a drill string to be lowered through a downwardly extending conductor. Deck 28 is further provided with means for storing drill pipe and equipment, as well as materials which will be used in the subsequent drilling of the wells into the ocean floor.

The elongated drill pipe or conductor 19 which extends from drilling vessel 21 into a well being prepared for drilling, is formed, as mentioned, of steel tubing of a desired diameter usually from 26 to 30 inches. Following drilling procedures, conductor 19 is normally lowered to the ocean floor and permitted to sink of its own accord, or set to a predetermined distance to where the resistance of the substrate will prohibit further embedment.

Referring to FIG. 2, provisional drill pipe guide 31 includes primarily a clamping head 32 having a pair of mating jaws 33 and 34 that are capable of firmly grasping the drill pipe or conductor of a completed or partially completed well. A guide sleeve assembly 36 is spaced from clamping head 32 and includes a pair of semicircular sleeve segments 37 and 38. The latter can be arranged to provisionally define a vertically aligned passage 30 for receiving a lowering drill pipe or conductor 19.

The latter two terms "drill pipe" and "conductor" are sometimes used interchangeably in the industry, depending on the actual construction of a well. For the sake of clarity in describing the invention, the terminology "drill pipe" will be designated hereinafter as being that casing which is first placed through the guide member and is embedded, and which forms the outer wall of a well. Normally, a drilling conductor 19 will then be registered within the drill pipe and driven for a distance into the substrate below the drill pipe. Conductor 19 will receive and guide a downwardly moving drill string to form the well.

Clamping head 32 and guide sleeve assembly 36 are held apart in spaced relation by an elongated rigid spacer bar 39. The latter is preferably fixed to one of said spaced apart members, and operably carried on the other member. The spacing between the respective members can thereby be adjusted to establish and fix a particular distance between wells in conformance with a well drilling pattern.

Clamping head assembly 32 as shown, includes essentially semicircular jaws 33 and 34 which, when cooperatively assembled, can be tightly clamped about a completed well's drill pipe or casing. In one embodiment, a corresponding edge of each jaw is provided with a self-compensating hinge 41. The latter includes a pair of vertically spaced brackets 42 and 43 which fixedly hold a hinge pin 44 therebetween.

The opposed edges of the respective clamp halves 33 and 34 opposite to the hinge 41, include parallel locking plates 51 and 52. A series of locking holes formed in each of said plates accommodates a set of locking bolts 54 and locking nuts 56.

Operationally, when the clamping head 32 is in the open position, and when lowered to the sea floor, the respective jaws 33 and 34 can be positioned around a completed well's drill pipe. This initial positioning by divers will align the respective locking holes 53 one with the other so that the locking bolts 54 can be slidably registered therein and tightened into locking nuts 56.

To allow the entire guide 31 to be rotatably moved about drill pipe 11, the locking bolts 54 will usually be pulled up only sufficiently tight to permit slidable engagement between the clamping head 33 and 32 and drill pipe 11.

This rotatable movement of the provisional drill pipe guide 31 about a drill pipe, can be facilitated by a set of downwardly projecting skirts 53 and 553*a*. The latter will serve to support the closed clamping head 32 from the ocean floor until being tightened into place.

Segment 34 of clamping head 32 includes an elongated split positioning sleeve 58 that extends substantially normal to the vertical axis of the clamping head. Said positioning sleeve as shown, is comprised of a pair of hinged members 59 and 61 which can be set to open position to receive a spacer bar 39 between the respective halves.

After spacer bar 39 has been positioned in place and longitudinally adjusted to achieve a desired spaced setting, sleeve 58 can be closed and tightened to firmly grip the bar. Such adjustment permits guide sleeve assembly 36 to be properly set to receive a lowering drill pipe.

To facilitate relative movements of sleeve 58, to allow entry of the spacer bar 39, one segment thereof is provided with a hinged edge. The latter includes a pair of hinge brackets 62 and 63 which mount a hinge pin 64 which is slidably received in an elongated slot 66 formed in each pair of spaced apart mounting tabs 68.

The function of sleeve 58 is to permit spacer bar 39 to be axially adjusted through the sleeve, thereby establishing a variable distance between the center of locking head 32 and the center of the remotely spaced drill guide sleeve 36.

Spacer bar 39 as shown, can comprise a tubular member to facilitate movement thereof through positioning sleeve 58. However, said spacer bar can likewise comprise a rectangular or square shaped member which is received in a set of corresponding jaws in the adjusting sleeve to facilitate the above noted setting or adjusting movement.

The drill pipe guide sleeve 36 is comprised as noted with at least two and preferably a pair of semicircular sleeve segments 37 and 38 which are cooperatively arranged to define circular opening 30 of sufficient size to receive downwardly moving drill pipe 19 as the latter enters the ocean floor.

Each guide sleeve segment is therefore provided around its upper edge with a generally conically shaped rim 70 and 70*a*. Said rim 70 and 70*a* defines an inwardly tapered surface to initially contact the lower edge of a downwardly moving drill pipe 19. The latter can thereby be registered in opening 30 and enter the ocean floor in its assigned spot.

Spacer bar 39 in one embodiment, is fixed to an outer wall of the guide segment 38. This is achieved by a socket 71 which depends from wall 38 in such manner that the spacer bar axis will be disposed substantially normal to the vertical opening 30 defined by the locked guide segments 37 and 38.

Said respective members as herein noted, are hinged so that they can be initially joined or closed to define the circular drill pipe guide opening. After the drill pipe has been embedded, the guide sleeve having completed its function, can be unlatched and removed from the set drill pipe.

The respective drill guide segments 38 and 39 are provided with a self-adjusting hinge arrangement 72 on one side and a set of locking plates 73 and 74 on the other. The latter are provided with aligned holes which receive locking bolts 77 and nuts 78 therethrough when the guide members are closed.

To permit the guide sleeve 36 to be properly positioned to slidably receive a drill pipe 19, at least one part of said sleeve, and preferably both halves are provided with a skirt or base plate 79. Said plate depends from the guide lower edge and extends outwardly a sufficient distance to form a bearing surface.

As a drill pipe 19 is lowered through the guide sleeve opening 30, any downward pressure exerted by said drill pipe will be transmitted to the skirt 79 thereby avoiding possible strain or deflection on the entire guide unit. The outwardly spreading skirt is fixed in position by a series of radial brackets 81 which extend from the skirt to sleeve segments 37 and 38 upper walls.

It is understood that although modifications and variations of the invention may be made without departing from the spirit and scope thereof, only such limitations should be imposed as are indicated in the apepnded claims.

We claim:

1. The combination with a first well drilled into the floor of an offshore body of water and having a first drill pipe (16) protruding upwardly therefrom, of a pipe guide for commencing a second well into said ocean floor at a predetermined distance and direction from said first well and comprising a clamping head (32) adapted for removable engagement with said first drill pipe (16) and operable to be selectively rotatably adjusted or fastened on said drill pipe, a drill pipe sleeve guide having a skirt at the lower end thereof for resting on the ocean floor, and defining a vertical opening for slidably registering a second drill pipe to position the latter for entry into the ocean floor at said predetermined distance from said first well, a spacer bar (39) depending from said drill pipe sleeve guide (36) and extending outwardly therefrom in a direction normal to said vertical opening, a spacer bar clamp (58) including at least two clamp members which depend from a side of said clamping head and define therebetween a generally horizontal passage for slidably receiving said spacer bar, said spacer bar clamp (58) being operable to fixedly engage a segment of said spacer bar (39) when said drill pipe sleeve is positioned said predetermined distance from said first well whereby to fixedly establish said predetermined distance and direction.

2. In the apparatus as defined in claim 1, wherein said spacer bar clamp is disposed on said clamping head in a manner to align said spacer bar in a direction substantially tangential to the first drill pipe.

3. In the apparatus as defined in claim 1, wherein said spacer bar clamp includes one member which depends from said clamping head, and a second member which is hinged to said first member at a hinged joint that extends parallel to the spacer bar.

* * * * *